United States Patent [19]

Dore

[11] 4,197,067

[45] Apr. 8, 1980

[54] COMPOSITE MOLD CONSTRUCTION

[75] Inventor: Kenneth E. Dore, Sanbornville, N.H.

[73] Assignee: General Electric Company, Somersworth, N.H.

[21] Appl. No.: 690,575

[22] Filed: May 27, 1976

[51] Int. Cl.[2] ..... B30B 11/00

[52] U.S. Cl. ..... 425/78; 425/3; 425/195; 425/DIG. 5; 249/168

[58] Field of Search ..... 249/119, 129, 163, 164, 249/165, 168, 169; 425/78, 3, DIG. 129, DIG. 5, 182, 183, 185, 186, 188, 190, 192, 193, 195, DIG. 44; 164/303

[56] References Cited

U.S. PATENT DOCUMENTS

| | | | |
|---|---|---|---|
| 2,282,155 | 5/1942 | Bandur | 425/78 |
| 2,298,885 | 10/1942 | Hull | 425/78 X |
| 2,482,342 | 9/1949 | Hubbert et al. | 425/78 |
| 2,572,984 | 10/1951 | Byers | 425/DIG. 5 |
| 2,714,226 | 8/1955 | Axelrod | 425/DIG. 44 |
| 2,896,299 | 7/1959 | Hemb | 249/119 X |
| 2,983,983 | 5/1961 | Mayer | 249/129 |
| 3,078,540 | 2/1963 | Bush | 425/78 |
| 3,156,011 | 11/1964 | Olson | 425/78 X |
| 3,608,623 | 9/1971 | Woltering | 164/303 X |
| 3,659,972 | 9/1972 | Garnett | 425/78 X |
| 3,743,455 | 7/1973 | Green | 425/78 |
| 3,797,986 | 3/1974 | Onder | 249/163 X |

FOREIGN PATENT DOCUMENTS

| | | | |
|---|---|---|---|
| 17588 | of 1955 | Fed. Rep. of Germany | 425/DIG. 129 |

*Primary Examiner*—J. Howard Flint, Jr.
*Attorney, Agent, or Firm*—Robert E. Brunson

[57] ABSTRACT

The disclosed invention consists of a composite mold for consolidating and conforming particulate solids into a compressed, shape-retaining mass. The mold comprises a matched pair of generally half sections, or assemblies thereof, provided with obliquely directed aligning keys whereby one half-section of the mold can recede from adjoining contact with the other in a generally oblique direction to extend the die cavity in two dimensions and thereby freely release the molded product intact, and then return to its initial position adjoining its counterpart half section for the next molding cycle. The mold construction of this invention is of particular utility in the molding of particulate inorganic magnetizable materials in the manufacture of permanent magnets of precise dimensions.

10 Claims, 5 Drawing Figures

COMPOSITE MOLD CONSTRUCTION

BACKGROUND OF THE INVENTION

The molding of powdered or granular dry materials such as particulate metals and oxides thereof or other inorganic compositions, to a compressed or densified shape-retaining body or configuration by the application of a high compressive force within the confines of an enclosing mold or die presents specific and difficult conditions which are not encountered to the same degree in the more common molding operations employing generally plastic and flowable cohesive type materials, such as deformable polymeric compounds or binder containing ingredients. For example, the molding of dry particulate solids requires very high pressures to consolidate and force the discrete solids into a shape-retaining mass of integrated particles, and at best the resultant molded product is often a highly friable body of compressed particles, whereas typical plastic or deformable cohesive materials or those containing an adhering binder, are usually flowable and conformable under moderate pressures and inherently constitute essentially coherent masses.

The application of very high pressures within the confines of an enclosing mold necessary to force discrete particulate solids into a shape-retaining mass, and the highly friable nature of the shaped body thereof, presents a situation whereby the removal or discharge of the resultant shaped product of consolidated powdered or granulated solids from within the confines of the mold is often difficult and time consuming. Moreover, the incident of breakage or damage to the friable molded bodies resulting from their removal from a consolidating mold is generally very high.

BRIEF DESCRIPTION OF THE INVENTION

This invention comprises an improved and unique composite mold construction for the consolidating and conforming under pressure of molding stocks of powdered or granular materials to a densified mass and product configuration. The mold construction provides for the separation of the mold components in a unique and predetermined manner to enable the fast and effective removal or discharge of the friable, particulate molded product intact or without damage, among other advantages.

OBJECTS OF THE INVENTION

It is a primary object of this invention to provide an improved mold construction for the compression molding of particulate molding stocks comprising powdered or granular solids to a consolidated, shape-retaining mass or product.

It is also an object of this invention to provide a composite mold construction which separates or opens for the quick and effective removal or discharge of the molded product of compacted particulate solids without damage to the friable molded product.

It is a further object of this invention to provide an improved composite mold for the compression molding of particulate mold stocks that is of a unique construction which is economical to product, operate and repair.

It is still further object of this invention to provide a composite mold assemblage whereby the sections separate by retraction in a biased or oblique predetermined direction to open or expand the die cavity or chamber in two dimensions and thereby free the molded product, and return in the same biased or oblique predetermined direction to restore the die cavity or chamber in proper alignment to its former closed or molding position or condition.

DESCRIPTION OF PREFERRED EMBODIMENTS

Figure 1:
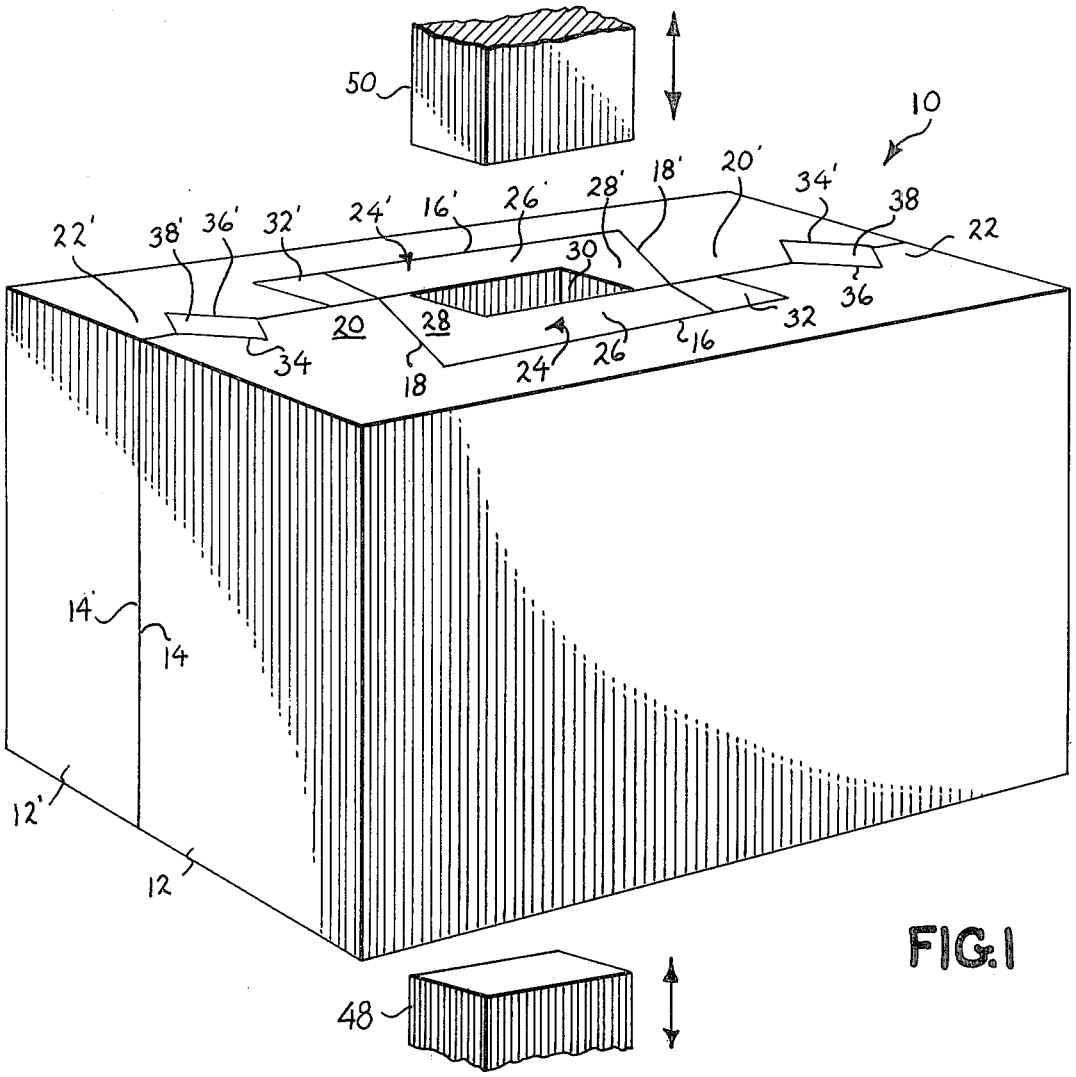
FIG. 1 of the drawing comprises a perspective view of one embodiment of the mold construction of this invention showing the mold unit in its closed position.

Referring to FIG. 1 of the drawing, the composite mold unit or assemblage 10 of this invention comprises a pair of matched mold blocks 12 and 12' which generally comprise like complementary half-sections. Each mold block has a corresponding surface portion 14 and 14' facing each other in adjoining counterposed relationship.

The facing surface portions 14, 14' of each mold block 12, 12', is provided with a recess 16, 16' located generally intermediate thereof. Recess 16, 16' of each mold block has at least one undercut side wall 18, 18'.

In a preferred embodiment of this invention, the recess 16, 16' extends substantially from one side or the top of the mold block to the opposite side or the bottom thereof, and thus forms a centrally located cut out portion or area traversing each mold block intermediate the remaining facing surface portions which thereby provide projecting areas 20, 20' and 22 22', as shown in the drawing.

At least one die segment of a composite die unit comprising two die segments 24 and 24', or more segments, is inserted into and secured within the recess 16, 16' of each mold block 12, 12'. In a preferred embodiment of this invention, each die segment 24, 24' consists of an L-shaped structure in cross-section comprising two adjoining walls or sides 26 and 28, 26' and 28'. Thus when the die segments of both mold blocks, each comprising two adjoining sides of appropriately corresponding dimensions, are adjoined in a counterposed relationship as shown in the drawing, the contacting combination thereof forms a composite die unit providing a surrounding enclosure or die cavity 30, or tetrahedral chamber, for the compression molding of powdered or granular mold stock therein.

Typically the die segment or segments residing in each mold block provides two adjoining walls or sides of the die cavity adjoined together at about a 90° or right angle whereby their abutment with the corresponding die segment or segments in an opposite mold block of the matched pair forms a generally rectangular die cavity. However the sides can be adjoined at other complementing angles whereby they combine to form surrounding die cavities of other configurations such as parallelograms or polyhedrons.

Die segment 24, 24', or segments, are securely fixed or locked into position within the recess 16, 16' by means of the undercut side wall 18, 18' and a clamping bar or member 32, 32' which is positioned within the recess adjacent to the die segment. The undercut in the recess wall can be of any significant slope such as an angle of about 10° or more which provides a secure grip. At least one and preferably two opposite sides of the die segment 24, 24' are provided with a slope of an angle which approximately complements the slope of the undercut wall 18, 18' of the recess 16, 16', such as a corresponding reverse slope of about 10°.

Also in a preferred embodiment of the invention, the side of the clamping bar 32, 32' abutting the die segment 24, 24' is undercut as shown to increase the strength of its grip upon the segment by functioning as a wedge. The undercut of the side of the clamping bar 32, 32' preferably corresponds to the slope of the undercut recess wall, such as an angle of about 10°. Thus, the clamping bar 32, 32' cooperates with the undercut wall of the recess to fix or lock the die segment in position within the recess 16, 16'.

Clamping bar 32, 32' can be secured in position by any suitable means such as countersunk screws or machine bolts (not shown) passing therethrough and threaded into the mold block 12, 12'. The die segments 24, 24' are therefore easily removable or replaceable, and when their dimensions are altered by wear, they can be repaired or reconditioned by the insertion of shims in the bases of the cavities under the segments and machining the resulting over extended surfaces of the die segments to restore them to the proper dimensions and configuration.

Both projecting areas 20 and 22, 20' and 22' of each facing surface portion 14, 14' of the mold blocks are provided with at least one key channel on each side the recess 16, 16', such as channels 34 and 36, 34' and 36' shown in the drawing. The two, or possibly more, channels in the facing surface portions of each mold block are parallel with respect to each other, and also in alignment and conterminous with the corresponding two or more channels in the opposite matching mold block when said mold blocks adjoin each other in a counterposed relationship as shown. Thus, the key channels of both of the matched and adjoined together mold blocks are respectively paired with their counterparts to provide common channels or grooves between the mold blocks when the mold blocks 12, 12' are combined in an adjoining counterposed relationship.

A key member or bar 38, 38' is provided within each pair of counterposed channels 34–36' and 36–34', as shown. Preferably one key member 38 is fixed in position within the key channel 36 of one mold block 12 of the matched pair thereof and another key member 38' is fixed in position within the counterpart channel 36' of the other mold block 12' of the matched pair. Thus, a key member is fixed, such as by countersunk screws or machine bolts passing therethrough and threaded into the mold block, in each of the opposed mold blocks in counterposed relationship for mating with an opposing conterminous key channel, or keying member therein, of the other mold block when the blocks are adjoined in a counterposed relationship.

The mating of the key members 38, 38' residing within the key channels of the mold blocks with their opposite key channels when the mold blocks are adjoined in a counterposed relationship, provides for a positive and accurate mechanical lateral alignment of the paired mold blocks and the die segments contained therein with respect to each other. Thus, the tolerances of the die cavity dimensions formed by the joined die segments are rigidly maintained throughout repeated cycles of openings and closings of the mold.

Figure 2:
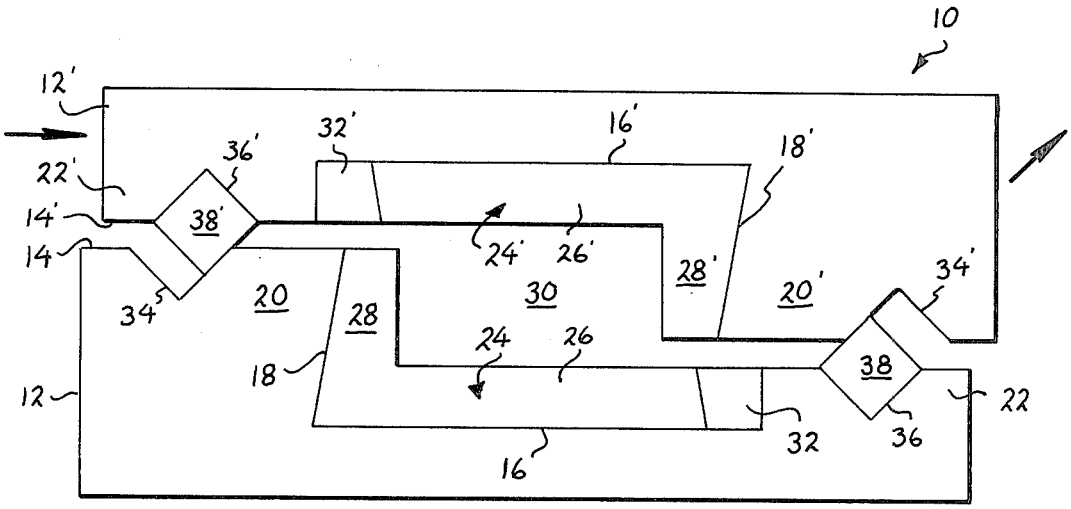
FIG. 2 of the drawings comprises a plan view of the mold construction of the embodiment of FIG. 1 showing the mold unit in its open position.

In the embodiment shown in FIGS. 1 and 2 of the drawing, the key channels 34 and 36, 34' and 36' are V-shaped grooves with an apex angle of approximately 45° as a preferred expediency to simplify the construction and related parts. Thus, the adjoined and counterposed paired channels 34–36' and 36–34' within the facing surface portions of matched and adjoined mold blocks will conveniently accommodate a key member 38, 38' which is square in cross-section, and positioned therein in a diamond-like arrangement. With such an arrangement the projecting converging portion of the aligning key system provides a biased or generally oblique surface or guide to control the alignment of the composite mold sections and regulate their lateral movement.

Figure 3:
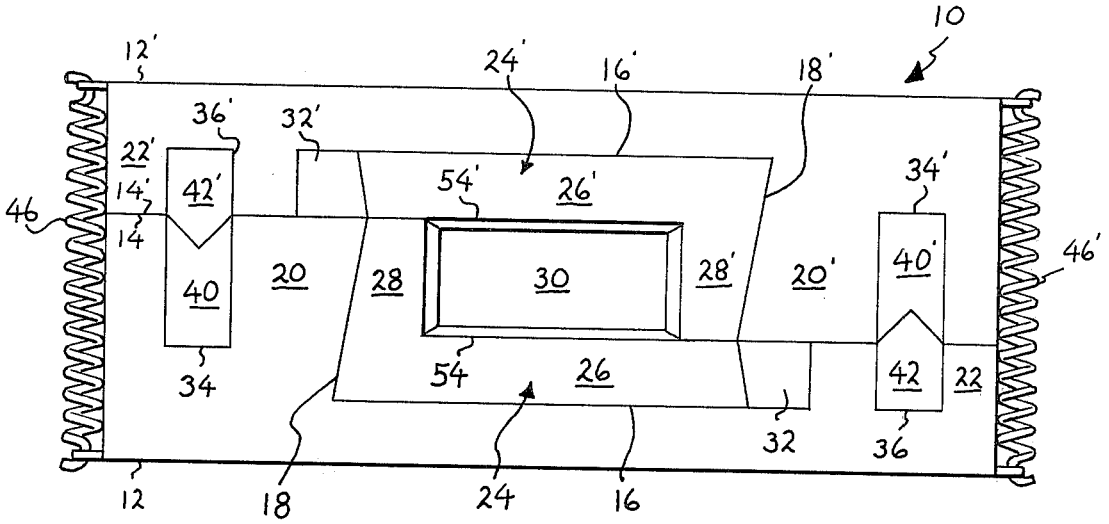
FIG. 3 of the drawings comprises a plan view of another embodiment of the mold construction of this invention.
Figure 4:
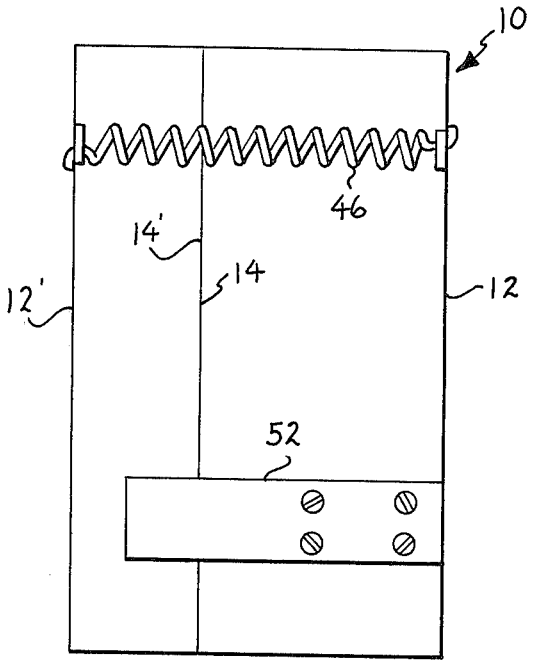
FIG. 4 of the drawings comprises an end view of the mold construction of the embodiment of FIG. 3 of this invention.
Figure 5:
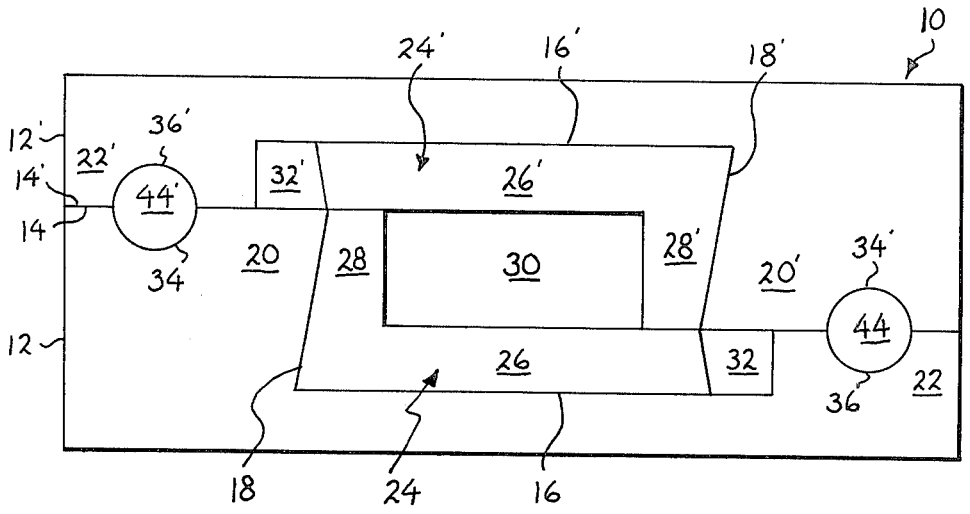
FIG. 5 of the drawings comprises a plan view of another embodiment of the mold construction of this invention.

However, key channels and/or key members of other angular configurations or shapes providing generally oblique surface guides and key mating systems can be used in the practice and construction of this invention as is illustrated in FIGS. 3, 4 and 5 of the drawings.

For example, as shown in FIG. 3 of the drawing, the key channels 34 and 36', 36 and 34' can be rectangular in cross-section, and the key members provided therein can be five-sided or quintehedral members adapted to aptly fit within the rectangular key channels and structured to form counterposed pairs of mating units 40 and 42, 40' and 42' with one member of each mating pair having a V-shaped outwardly converging projecting portion and the other member of each mating pair having a corresponding inwardly converging grooved portion for the mating union thereof. For convenience of machining and design, the apex angles of both the converging projecting portion and the corresponding converging grooved portion of the mating members are preferably approximately 45°.

In this embodiment of the invention, the members of the mating key unit 40 and 42, 40' and 42' can be fixed in the channels 34 and 36, 34' and 36', with suitable means such as countersunk screws or machine bolts (not shown) passing therethrough and threaded into the mold block.

Another modification or variation of the obliquely directed aligning keys of the composite mold construction of this invention is shown in FIG. 5 of the drawing. In this embodiment of the invention the key channels 34 and 36, 34' and 36' in the facing surface portion 14, 14' of each mold block 12, 12' are generally semicircular or of other curved concave configuration rather than angular, and the key members 44, 44' are cylindrical bars or of other appropriate curved cross-sectional configuration which compliment the shape of the channels.

In accordance with the construction of the composite mold of this invention, the two mold blocks 12, 12', including the die segments 24, 24' secured therein and the aligning key components, of a matched pair of the generally half-sections of the composite mold structure are maintained in an adjoining counterposed relationship, such as shown in FIGS. 1, 3, 4 and 5 of the drawings, for the molding operation by means of a suitable mechanical clamp or vice-like device (not shown). Resilient retaining or holding means, such as springs 46,

46', shown in FIGS. 3 and 4 attached to the mold blocks of each half-section can be used as a convenience to press or retain the components in a generally adjoining but separable arrangement. The resilient retaining means, or springs 46, 46' can be located internally within a suitable chamber in the mold blocks, or externally as shown.

Thus, when the half-section assemblies comprising the mold blocks and related components of the composite mold 10 are in adjoining contact, and thus strongly secured by suitable clamping means, they provide a surrounding die cavity 30 for compression molding therein. For example, two L-shaped die segments complement each other when adjoined in a counterposed relationship to provide a closed tetrahedron defining the die cavity. Suitable means are provided to close off the lower portion or bottom open end of the die cavity 30, such as a bottom plate providing a floor under the cavity or a plunger 48, shown in FIG. 1 of the drawing, which moves up and enters into the lower open end of die cavity 30. Upon closing off one or the lower open end of the die cavity, it is ready to receive a charge of particulate molding stock.

The compression molding operation with the composite mold construction of this invention can be effected in a conventional manner for the application of the compressing and conforming force upon particulate molding stock contained within the fixed confines of the die cavity. For example, a reciprocatable plunger 50, shown in FIG. 1 of the drawing, can be provided to decend downward and move into the other or upper open end of the die cavity 30 and thereby compress and consolidate the contents of cavity 30 to a densified mass of the dimensions and configuration of the interior of the die cavity.

Consolidation and conformation of the particulate molding stock within the die cavity can be effected with the mold construction of this invention by the application of pressure in one direction while all other surface areas or faces of the enclosing die cavity 30 are fixed or static, or by the application of pressure in two directions opposing each other while all other cavity surface areas or faces are fixed or static. In the former system, the lower portion or end of the die cavity is simply blocked off by suitable means as noted hereinbefore, and the compressive force is applied in one direction, such as from above or at the other or upper open end of the mold, for example, plunger 50 pressing down into the cavity 30. In the latter system, a pair of opposing compression plungers, such as plungers 48 and 50, enter from opposite directions into the die cavity 30 from both the upper and lower openings, or each end of the cavity, and apply a compressive force in each direction. Upon completion of the compressing step or operation, either or both plungers, 48 and 50, are withdrawn from die cavity 30 to provide for the subsequent removal or discharge of the molded product for within the confines of the mold cavity.

An especially significant, if not the foremost feature and advantage of the mold construction of this invention is the means and manner by which the mold, or die cavity thereof separates or opens to enable the release or discharge of the consolidated mass or molded product of particulate material which has been compressed within the die cavity under high pressure.

In accordance with this invention and the operation of the composite mold construction thereof, one or both of the mold half-section components, or assemblies including a mold block 12 or 12' and die segment 24 or 24' fixed therein, retracts or withdraws in a biased or oblique course, such as in a direction of about 45°, away from the other half-section in the manner shown in FIG. 2 of the drawing.

The retraction of one half-section or component of the composite mold can be effected by first releasing any clamping means rigidly holding the composite sectional mold in its closed and adjoining arrangement, and withdrawing one or both of said half-sections or components back away from the other in a generally biased or oblique direction whereby the two adjoining sides of the L-shaped die segment or segments of one mold half-section or component retreat from the corresponding two adjoining sides of the L-shaped die segment or segments of the other half-section or component of the mold. Thus, the die cavity 30, containing the consolidated product of particulate solids compressed therein, is opened and expanded by extension of its internal area in both dimensions of the surrounding mold structure as shown in FIG. 2 of the drawing, and the consolidated product is freed and released from all confining forces or pressure within the die cavity and thus is unconfined for removal or discharge therefrom intact.

The retraction of one or both half-sections of the composite mold 10 in a biased or oblique course from the other to effect an opening of the enclosed die cavity simultaneously in two dimensions, and the subsequent return of the mold sections to adjoining contact with the tight closing of the die cavity to its exact predetermined dimensions and relative positioning is provided for by utilizing the projecting biased or oblique surfaces of the aligning key system as a guide to direct the course or path of lateral movement for both the retraction and return. Thus, by applying a force at an appropriate location of a half-section of the composite mold unit, such as pressure directed upon the end of one mold block 12' as illustrated by the arrow in FIG. 2 of the drawing, the mold block illustrated as 12' is forced away from its other counterpart mold block illustrated as 12 in a biased or oblique direction, as shown by the arrow, as it is guided over its course or path of movement by the biased or oblique projecting surfaces of the aligning key system. This course or path of movement of the retracting mold component in turn opens the die cavity 30 simultaneously in two dimensions thereby freeing the molded charge in all dimensions. Moreover, the aligning key system of the composite mold construction of the invention guides the movement of the components in their return to adjoining contact and accurate resumption of the closed die cavity.

As shown in FIG. 4 of the drawing, a mechanical stop member 52 can be utilized to assist in the realignment of the sections of the composite mold and reduce the possibility of inadvertant displacement due to accidental external forces. Also, a porton of the die segments 24, 24' can be beveled such as at 54, 54' to facilitate the filling of the die cavity 30 with particulate molding stock.

The mold construction and arrangement of this invention is especially useful and advantageous in the manufacture of permanent magnets from particulate inorganic magnetizable materials such as magnetic metal oxides, and provides for the consolidation and molding of such materials to integrated magnets of precise dimensions and configuration.

Although the invention has been described with reference to certain specific embodiments thereof, numerous modifications are possible and it is desired to cover all modifications falling within the spirit and scope of this invention.

What I claim as new and desire to secure by Letters Patent of the United States is:

1. A composite mold for the compression consolidating and conforming of powdered stock to a densified configuration, comprising:

(a) a pair of mold blocks matched together with corresponding surface portions facing each other in adjoining counterposed relationship;

(b) the facing surface portion of each matched mold block having therein an intermediately located recess with at least one undercut side wall for the containment of an insertable die segment;

(c) a die segment of a composite die inserted into and secured within the recess of each facing surface portion of the matched pair of mold blocks, said die segment of each facing surface portion comprising two adjoining sides whereby said die segments combine to form a composite die unit providing a surrounding die cavity when contiguously united together by adjoining the facing surface portions of the matched pair of mold blocks in counterposed relationship; and (d) the facing surface portion of each matched mold block having therein at least two elongated parallel aligning key channels with at least one channel located on each side of the intermediate recess for a die segment, and at least one of said key channels located on each side of the recess containing a self-aligning key member having a section thereof with an oblique surface projecting out from the facing surface portion of the mold block for mating and aligning with a complementary counter-shaped key recess in the key channel of the corresponding facing surface portion of the other mold block of the matched pair when said mold blocks are adjoined in a counterposed relationship, whereby said die cavity formed of the the die segments having two adjoining sides and said key members with an oblique surface provide for a mold block to recede from adjoining contact with the other mold block in a generally oblique direction to extend the die cavity in two directions and thereby freely release a molded product.

2. The composite mold of claim 1, wherein each mold block contains a die segment therein comprising two sides adjoining each other at approximate right angles whereby said die segments combine to form a surrounding rectangular die cavity when the matched pair of mold blocks and the die segments contained therein are adjoined together in counterposed relationship.

3. The composite mold of claim 1, wherein the recess for the containment of a die segment traverses the facing surface portion of each mold block, and contains therein a clamping bar having an undercut side for positioning adjacent to the die segment within the recess whereby the die segment is wedged within the recess in the mold block between the undercut side wall of the recess and the undercut of the clamping bar.

4. A composite mold for the compression consolidating and conforming of powdered stock to a densified configuration, comprising:

(a) a pair of mold blocks matched together with corresponding surface portions facing each other in adjoining counterposed relationship;

(b) the facing surface portion of each matched mold block having therein an intermediately located recess with at least one undercut side wall for the containment of an insertable die segment;

(c) a die segment of a composite die unit inserted into and secured within the recess of each facing surface portion of the matched pair of mold blocks, said die segment of each facing surface portion comprising two adjoining sides whereby said die segments combine to form a composite die unit providing a surrounding die cavity when contiguously united together by adjoining the facing surface portions of the matched pair of the mold blocks in counterposed relationship; and (d) the facing surface portion of each matched mold block having therein at least two elongated parallel aligned key channels with at least one channel located on each side of the intermediate recess for a die segment and each of said key channels being conterminous with a corresponding channel in the other facing surface portion of a counterposed mold block when said matched mold blocks are in adjoining relationship whereby the corresponding channels within each facing surface portion provides a common key channel therebetween, and a mating pair of aligning key members residing in at least one common key channel on each side of the intermediate recess, said mating pair of aligning key members comprising one member having an outward converging projecting portion with at least one oblique surface and the other member having an inward converging grooved portion with at least one oblique surface generally corresponding with the configuration of the projecting portion of the other member for a mating union thereof and the alignment of the matched pair of mold blocks when said mold blocks are adjoined in a counterposed relationship, whereby said die cavity formed of the die segments having two adjoining sides and said key members with an oblique surface provide for a mold block to recede from adjoining contact with the other mold block in a generally oblique direction to extend the die cavity in two directions and thereby freely release a molded product.

5. The composite mold of claim 4, wherein each mold block contains a die segment therein comprising two sides adjoining each other at approximate right angles whereby said die segments combine to form a surrounding rectangular die cavity when the matched pair of mold blocks and the die segments contained therein are adjoined together in a counterposed relationship.

6. The composite mold of claim 4, wherein the recess for the containment of a die segment traverses the facing surface portion of each mold block, and contains therein a clamping bar having an undercut side for positioning adjacent to the die segment within the recess whereby the die segment is wedged within the recess in the mold block between the undercut side wall of the recess and the undercut side of the clamping bar.

7. A composite mold for the compression consolidating and conforming of powdered stock to a densified configuration, comprising:

(a) a pair of like mold blocks matched together with corresponding surface portions facing each other in adjoining counterposed relationship;

(b) the facing surface portion of each matched mold block having therein an intermediately located recess with at least one undercut side wall for the containment of an insertable die segment;

(c) a die segment of a composite die unit inserted into and secured within the recess of each facing surface portion of the matched pair of mold blocks, said die segments of each facing surface portion having two adjoining sides whereby they form a composite die unit providing a surrounding die cavity when contiguously united together by adjoining the facing surface portions of the matched pair of mold blocks in counterposed relationship; and (d) the facing surface portion of each matched mold block having therein two elongated parallel aligned key channels with one channel located on each side of the intermediate recess for a die segment and each of said key channels being conterminous with a corresponding channel in the other facing surface portion of a counterposed mold block when said matched mold blocks are in adjoining relationship whereby the corresponding channels within each facing surface portion provide a common key channel therebetween, and at least two aligning key members with at least one within each of the common key channels and having a outward converging projecting portion with at least one oblique surface for mating with a generally corresponding oblique surface provided within the common key channel of the matched pair of mold blocks when said mold blocks are adjoined in a counterposed relationship, whereby said die cavity formed of the die segments having two adjoining sides and said key members with an oblique surface provide for a mold block to recede from adjoining contact with the other mold block in a generally oblique direction to extend the die cavity in two directions and thereby freely release a molded product.

8. The composite mold of claim 7, wherein each mold block contains a die segment therein having two sides adjoining each other at approximate right angles whereby said die segments combine to form a surrounding rectangular die cavity when the matched pair of mold blocks and the die segments contained therein are adjoined together in a counterposed relationship.

9. The composite mold of claim 7, wherein the recess for the containment of a die segment traverses the facing surface portion of each mold block and contains therein a clamping bar having an undercut side for positioning adjacent to the die segment within the recess whereby the die segment is wedged within the recess in the mold block between the undercut side wall of the recess and the undercut side of the clamping bar.

10. A composite mold for the consolidating and conforming of powdered stock to a densified configuration, comprising:

(a) a pair of like mold blocks matched together with corresponding surface portions facing each other in adjoining counterposed relationship;

(b) the facing surface portion of each matched mold block having therein an intermediately located recess with at least one undercut side wall for the containment of an insertable die segment;

(c) a die segment of a composite die unit inserted into the recess with an adjacent clamping bar having an undercut side for positioning adjacent to the die seqment within the recess whereby the die segment is wedged within the recess in the mold block between the undercut of the side wall of the recess and the undercut side of the clamping bar, said die segment of each facing surface portion having two sides adjoining each other at approximatey right angles whereby said die segments combine to form a composite die unit providing a surrounding die cavity when contiguously united together by adjoining the facing surface portions of the matched pair of mold blocks in counterposed relationship; and (d) the facing surface portion of each matched mold block having therein two elongated parallel aligned key channels with a channel located on each side of the intermediate recess for a die segment and each of said key channels being conterminous with a corresponding channel in the other facing surface portion of a counterpart mold block when said matched mold blocks are in adjoining relationship whereby the corresponding channels within each facing surface portion provides a common key channel therebetween, and a mating pair of aligning key members residing in at least one common key channel on each side of the intermediate recess, said mating pairs of aligning key members comprising one member having an outward converging projecting portion with oblique surfaces and the other member having an inward converging grooved portion with oblique surfaces generally corresponding with the configuration of the projecting portion of the other member for a mating union thereof and the alignment of the matched pair of mold blocks when said mold blocks are adjoined in a counterposed relationship, whereby said die cavity formed of the die segments having two adjoining sides and said key members with an oblique surface provide for a mold block to recede from adjoining contact with the other mold block in a generally oblique direction to extend the die cavity in two directions and thereby freely release a molded product.

* * * * *